US011054200B1

(12) United States Patent
Cozad

(10) Patent No.: US 11,054,200 B1
(45) Date of Patent: Jul. 6, 2021

(54) BUFFER SYSTEMS AND METHODS FOR FIREARMS

(71) Applicant: Andrew David Cozad, Oil City, PA (US)

(72) Inventor: Andrew David Cozad, Oil City, PA (US)

( * ) Notice: Subject to any disclaimer, the term of this patent is extended or adjusted under 35 U.S.C. 154(b) by 0 days.

(21) Appl. No.: 16/873,631

(22) Filed: May 26, 2020

(51) Int. Cl.
*F41A 3/84* (2006.01)
*F41A 11/02* (2006.01)

(52) U.S. Cl.
CPC ..... *F41A 3/84* (2013.01); *F41A 11/02* (2013.01)

(58) Field of Classification Search
CPC ..... F41A 3/78; F41A 3/80; F41A 3/82; F41A 3/84; F41A 11/02; F41A 25/12; F41C 23/08
See application file for complete search history.

(56) References Cited

U.S. PATENT DOCUMENTS 7,131,367 B1 * 11/2006 Boerschig ..... F41A 3/94 89/198
8,141,287 B2 3/2012 Dubois
9,080,823 B1 * 7/2015 Mantas ..... F41A 3/84
9,341,437 B1 * 5/2016 Huang ..... F41A 3/84
9,995,545 B2 2/2018 Geissele
9,970,722 B1 * 5/2018 Babb ..... F41A 3/82
10,100,896 B2 * 10/2018 Spyche, Jr. ..... F41A 25/02
10,619,956 B1 * 4/2020 Zhang ..... F41A 3/84
10,712,108 B2 * 7/2020 Cozad ..... F41A 3/84
2013/0319217 A1 * 12/2013 Gangl ..... F41A 3/84 89/198
2014/0224112 A1 8/2014 Verry
2017/0067716 A1 * 3/2017 Huang ..... F41C 23/06
2017/0314886 A1 * 11/2017 Huang ..... F41A 25/12
2020/0096269 A1 * 3/2020 Cozad ..... F41A 3/84

* cited by examiner

*Primary Examiner* — Benjamin P Lee
(74) *Attorney, Agent, or Firm* — Jeffrey Vaitekunas

(57) ABSTRACT

A buffer assembly to reduce recoil in a firearm includes a main body that is hollow from an opening extending from the end of the main body to about a shoulder that engages a recoil spring. An end cap is insertable into the opening and has a central hole, with a first larger diameter through a first portion and a second smaller diameter through a second portion. An operational rod has a first portion with a larger diameter and a second portion with a smaller diameter, sized to slidingly fit in the second smaller diameter hole of the end cap. The first portion's diameter is larger than the second smaller diameter of the end cap, providing a stop for the operational rod such that the operational rod cannot slide out of the end cap, and the second portion extends out from the end cap and terminates in a bumper.

11 Claims, 13 Drawing Sheets

(Prior-Art)

(Prior-Art)

BUFFER SYSTEMS AND METHODS FOR FIREARMS

RELATED APPLICATIONS

The present application is a continuation of and claims the benefit of U.S. patent application Ser. No. 16/350,053 filed Sep. 21, 2018.

TECHNICAL FIELD

Embodiments of the technology relate, in general, to firearm technology, and in particular to an improved buffer system for semi-automatic or automatic firearms.

SUMMARY

The present disclosure provides a buffer assembly for a firearm, and in particular for AR-15, M16, M4 carbine, SR-25, AR-10 and LR-308 type rifles. In particular, the present disclosure provides a buffer assembly with reduced recoil and enhanced fatigue resistance for this type of rifle. A buffer assembly for a firearm in one particular embodiment includes a circularly cylindrical main body having a collar portion at a first end of the main body, a sleeve portion at a second end of the main body and a shoulder portion between the collar portion and the sleeve portion, wherein the sleeve portion is hollow from an opening extending from the second end of the main body into the main body to about the shoulder portion, and wherein the collar portion has a diameter larger than the diameter of the sleeve portion, the change in diameter from the collar portion to the sleeve portion defining the shoulder portion. An end cap having a first portion is insertable into the opening at the second end of the main body and has a second portion with a central hole, wherein the central hole has a first larger diameter through a first portion of the central hole and a second smaller diameter through a second portion of the central hole. An operational rod having a first portion and a second portion, wherein the first portion has a larger diameter and the second portion has a smaller diameter, is sized to slidingly fit in the second smaller diameter hole of the end cap. The first portion's diameter is larger than the second smaller diameter of the end cap, providing a stop for the operational rod such that the operational rod cannot slide out of the end cap, and the second portion extends out from the end cap and terminates in a bumper.

The buffer assembly may be removably insertable in at least one of an AR-15, M16, M4 carbine, SR-25, AR-10 and LR-308 type rifle. Additionally, in another embodiment, a firearm may include the buffer assembly when manufactured. In another embodiment, the buffer assembly may have the first portion of the end cap threaded and the opening in the main body threaded to accept the end cap into the opening by threading the end cap into the opening. The buffer assembly may include a spring between the larger portion of the operational rod and the shoulder portion of the main body that biases the larger portion of the operational rod against the end cap. The buffer assembly may also include a stabilizer weight inside the main body.

In another embodiment, a buffer assembly for a firearm may include a main body containing a spring, the main body having a shoulder at a first end and an opening at a second end that matingly engages with an end cap. An operational rod may be provided with a first portion slidingly contained inside the main body, the first portion of the operational rod engaging the spring such that as the operational rod reciprocatingly slides within the main body the spring is reciprocatingly compressed and un-compressed. The operational rod may have a second portion outside the main body, the second portion terminating in a bumper. The bumper may include an elastomeric portion removably attached to a tail piece, wherein the termination of the second portion of the operational rod may terminate in the tail piece.

In one embodiment, the operational rod is coupled to the tail piece using a set screw as well as threaded into the tail piece. The elastomeric portion may be attached to the tail piece using a spring biased pin.

In one embodiment the first portion of the operational rod is defined by a rod diameter, and the first portion of the operational rod includes an enlarged portion, wherein the enlarged portion of the first portion of the operational rod mates into an enlarged portion of an opening in the end cap and the operational rod diameter slidingly engages a smaller portion of the opening in the end cap such that the end cap maintains a preload compression on the spring in the main body. The end cap may have an externally threaded portion and the opening of the main body may have an internally threaded portion that matingly engages the outer threads of the end cap to hold the end cap onto the main body. The buffer assembly may further include a stabilizer weight inside the main body that surrounds a portion of the spring and slides within the main body providing a rebound force that assists the closing of the bolt on the rifle.

In still a further embodiment, a method of reducing recoil in a firearm includes the steps of providing a buffer assembly having a main body containing an internal buffer spring, the main body having a shoulder at a first end and an opening at a second end that matingly engages with an end cap; an operational rod with a first portion slidingly contained inside the main body, the first portion of the operational rod engaging the internal buffer spring such that as the operational rod reciprocatingly slides within the main body the spring is reciprocatingly compressed and un-compressed; the operational rod having a second portion outside the main body, the second portion terminating in a bumper; inserting the buffer assembly into a coil spring such that the shoulder of the buffer assembly abuts the end of the spring and the bumper is inserted inside the coil spring; inserting the coil spring and buffer assembly into a rifle such that the cyclic action of the rifle's bolt pushes the buffer assembly and compresses the coil spring until the bumper hits a stop before the rifle completes its cycle; and using the completion of the rifle's cycle to compress the internal buffer spring, thereby reducing the recoil.

Embodiments of the method may further involve the step of selecting at least one of an AR-15, M16, M4 carbine, SR-25, AR-10 and LR-308 type rifle. In another embodiment where the rifle cycles repeatedly for a plurality of cycles with a single trigger pull, the completion of each cycle from the plurality of cycles compresses the internal buffer spring, thereby reducing muzzle rise over the plurality of cycles.

BRIEF DESCRIPTION OF THE DRAWINGS

The present disclosure will be more readily understood from a detailed description of some example embodiments taken in conjunction with the following figures;

FIG. 76 is a side sectional view of the main body of the buffer assembly;

FIG. 116 is a side sectional view of the stabilizer weight illustrated in FIG. 11A;

DETAILED DESCRIPTION

Figure 1:
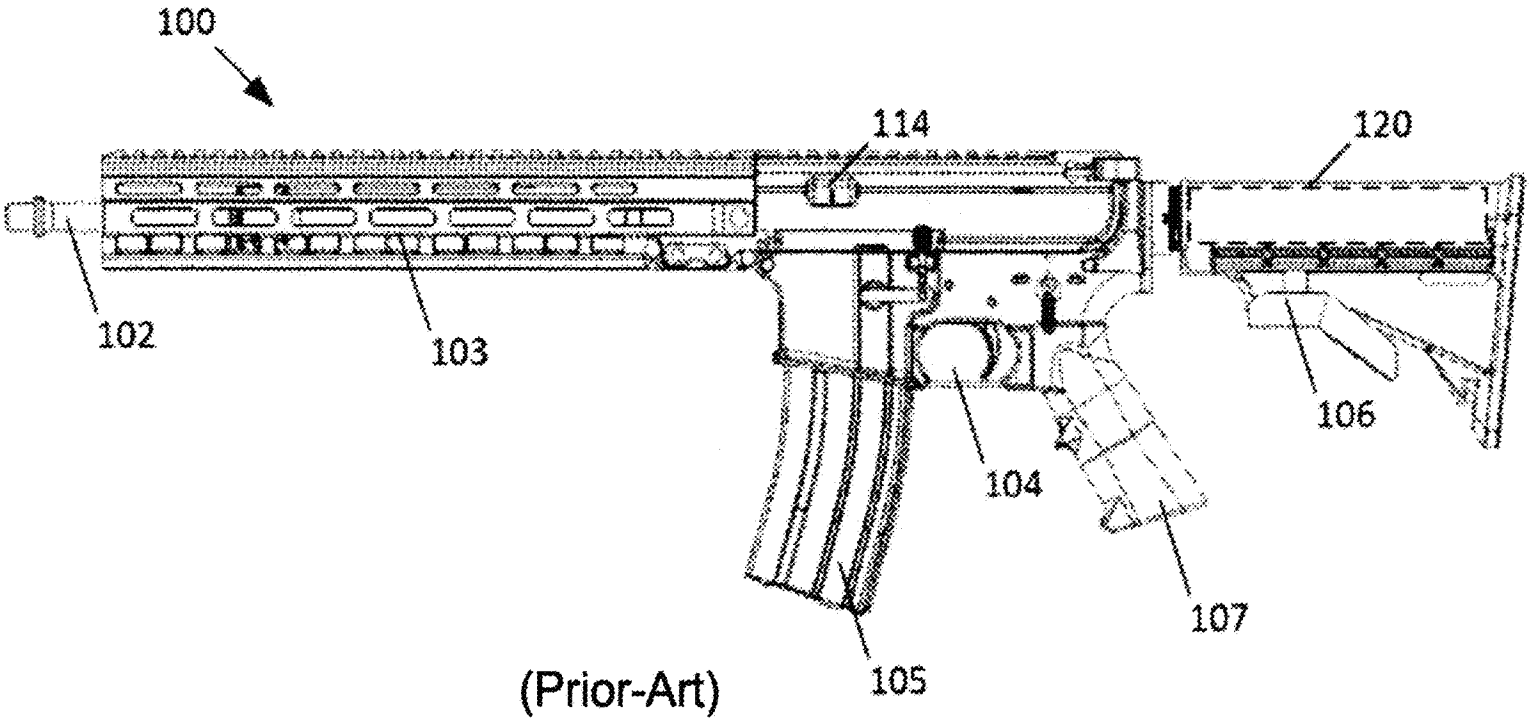
FIG. 1 is a right elevation view of a firearm useful with a buffer assembly in accordance with the present invention.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

Buffer assemblies are commonly provided in firearms, such as rifles, and function both to reduce recoil and to assist in the reloading of cartridges into the chamber in an automatic or semi-automatic firearm. Typically, a buffer assembly in the firearm includes a buffer tube, a buffer spring, and a buffer. The buffer spring is mounted onto the buffer, both of which are positioned within the buffer tube. Once a round is fired by the firearm, the bolt carrier is thrust in a rearward direction by the force of the firing round. As a result, the buffer spring is compressed by this action and provides the necessary return force to return the bolt carrier in a forward action to pick up a new round and to load the round into the chamber. The action of the spring in the buffer assembly and the mass of the buffer also function to reduce the recoil of the firearm by spreading the force of the fired round over a greater period of time. As the buffer assembly cycles every time a round is fired, the spring can be exposed to a high number of cycles, especially when used in fully automatic rifles. This high number of cycles can result in fatigue and wear over time, and eventually to the point of not being able to satisfactorily perform the above noted functions.

Described herein are example embodiments of apparatuses, systems, and methods useful for semi-automatic or automatic action firearms. In one example embodiment, the buffer is assembled from multiple components such that the firearm has reduced recoil, thereby improving operator accuracy, extending component life, and improving the user's experience when shooting the firearm.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Example embodiments described herein can reduce felt recoil when shooting the firearm. For example, reducing recoil allows for faster follow-up shots by staying on-target, reduces a shooter's tendency to flinch improving accuracy, and improves the shooting experience by reducing the impact to the shooter of the recoil from the shot. In one particular embodiment, a buffer assembly in accordance with the present invention may be used in cooperation with a firearm using a suppressor to reduce sound emitted when firing the gun. Use of a suppressor on a firearm reduces the sound pressure emitted from the barrel, but simultaneously increases the pressure of the gasses entering the recoil system of the firearm. These increased gas pressures cause more intense recoil of the buffer assembly, which can lead to failure of components in the firearm causing a malfunction of the gun. The increased gas pressure also causes more kick from the gun that could lead to muzzle rise under automatic fire conditions, reducing accuracy. An improved buffer assembly in accordance with the present invention reduces the shock of the recoil, reduces component failures, and reduces muzzle rise as it reduces the recoil felt from firing the gun.

Figure 2:
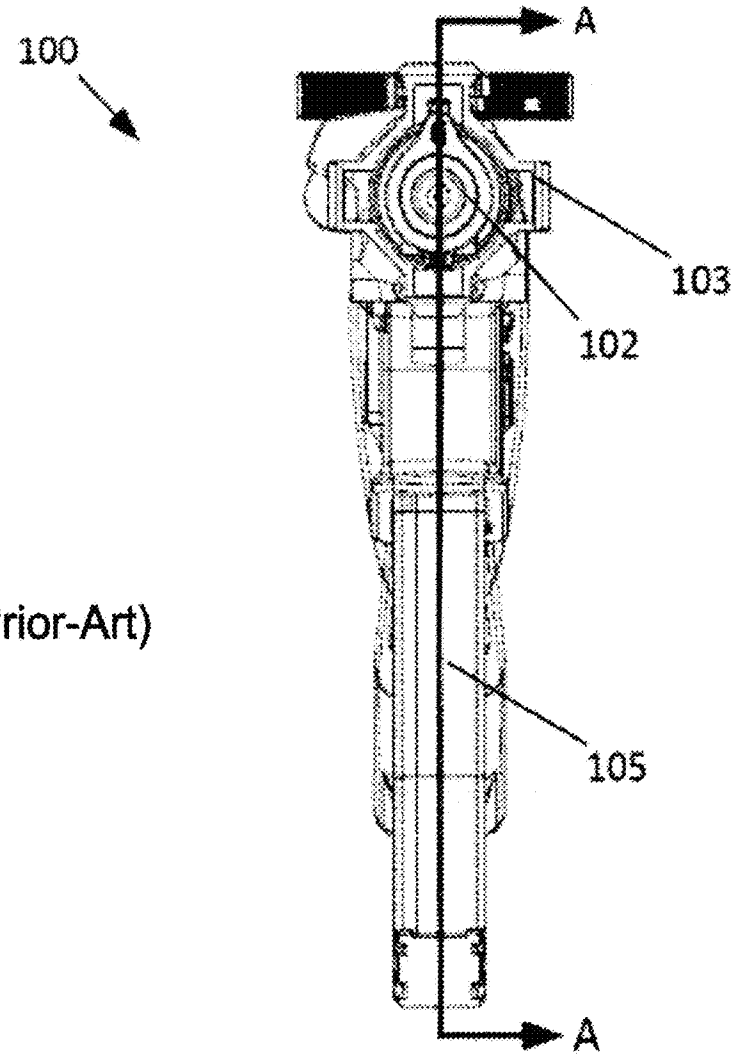
FIG. 2 is a front elevation view of the firearm of FIG. 1.

The present disclosure provides an improved recoil reducing buffer assembly for a firearm, such as an AR-15, M16, M4 carbine, SR-25, AR-10 or LR-308 type rifle, among other similar type rifles using spring/buffer assemblies. Referring to FIGS. 1 and 2, a firearm 100 is shown. For purposes of illustration, and not limitation, in the particular embodiment depicted the firearm 100 is an AR-15, M16 type rifle having components including a barrel 102, hand guard 103, trigger assembly 104, magazine 105, a buttstock 106, a handle 107, and a chamber 114. FIG. 1 additionally schematically depicts a buffer assembly 120 located within the buttstock 106 of the firearm 100. An example of the buffer assembly 120 is illustrated and described in more detail herein, such as with reference to FIGS. 3-4.

Figure 3:
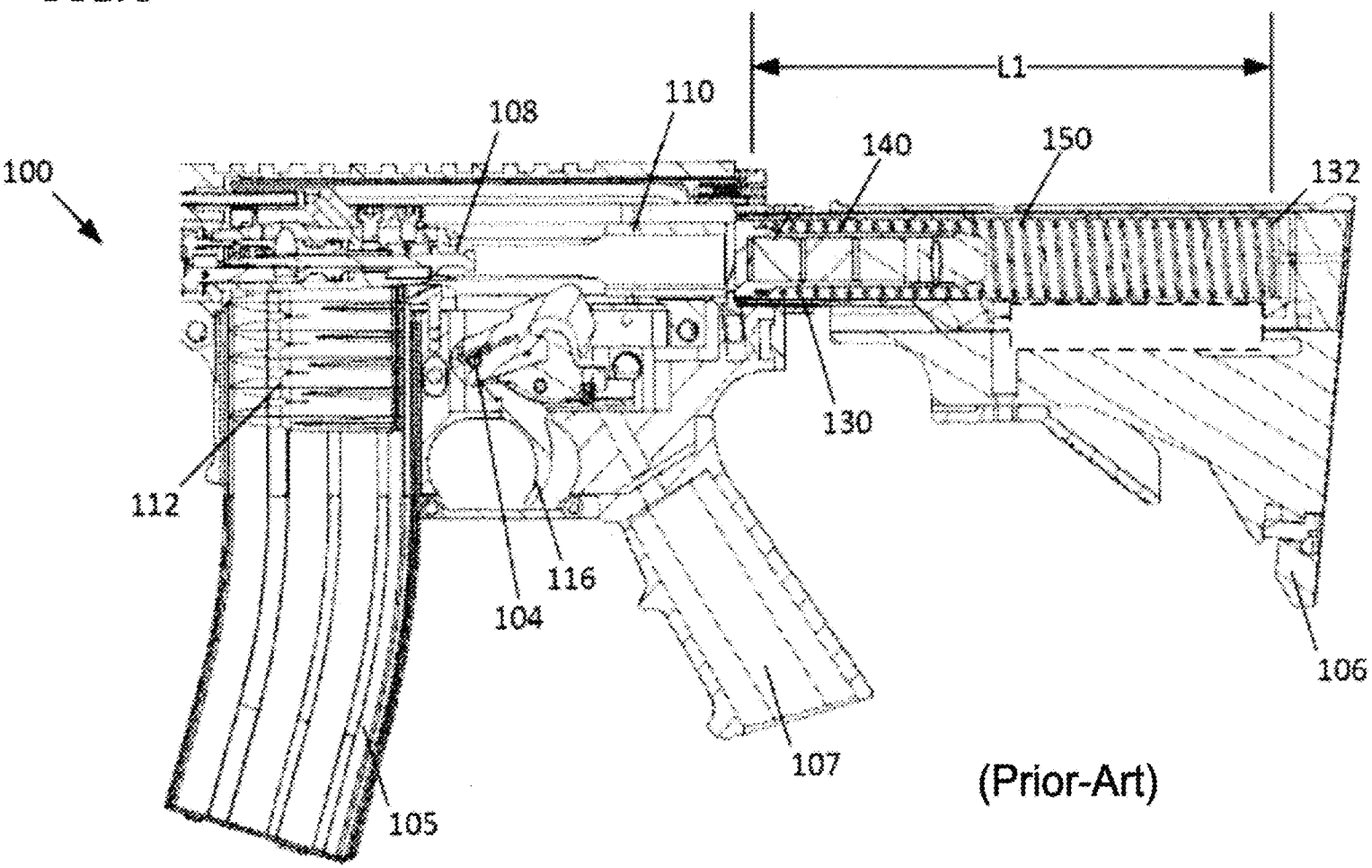
FIG. 3 is a cross-section view of the firearm illustrated in FIG. 1.
Figure 4:
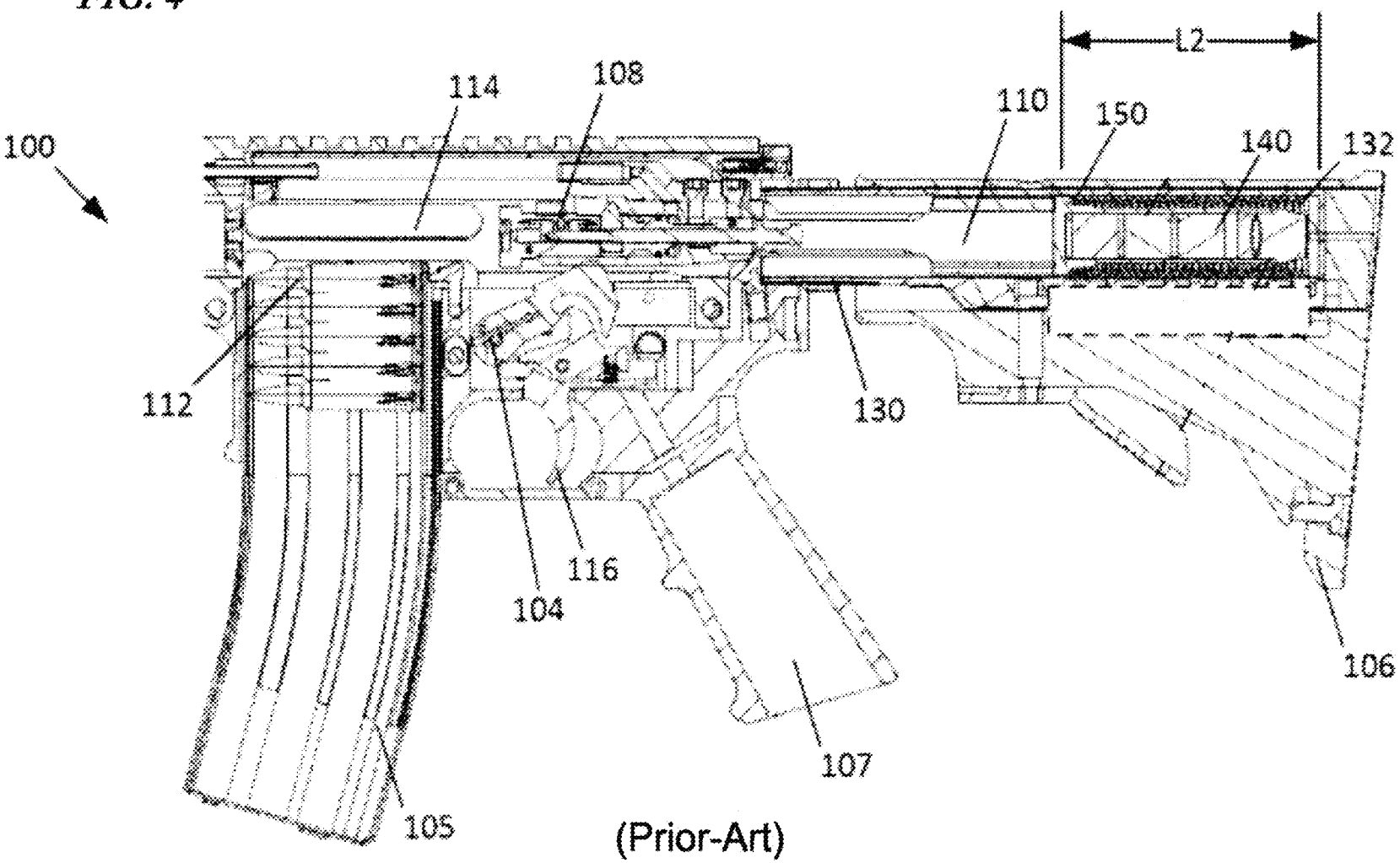
FIG. 4 is a cross-sectional view of the firearm of FIG. 1 taken along the line A-A illustrated in FIG. 2 with the buffer assembly in an expanded state.

FIGS. 3 and 4 show cross-sectional views of the internal components of the firearm 100, taken along the line A-A shown in FIG. 2. FIGS. 3 and 4 are the same, with the exception of the position of the internal components within the firearm, as explained herein. FIGS. 3 and 4 further detail that the firearm 100 includes a bolt carrier group 108 including a bolt 110. In generalized terms, the bolt 110 reciprocates within the firearm 100 in rearward and then a forward motion, and during the forward motion operates to strip the magazine 105 of a round 112 and to load the round 112 into a chamber 114 where it is once again ready for firing. FIG. 3 shows the bolt 110 in its most forward position. After firing, gases from the fired round force the bolt 110 into a rearward motion, causing the spent round to be ejected from the chamber 114 and the bolt 110 to be moved to its most rearward position. FIG. 4 shows the bolt 110 in this position. When the firearm 100 is an automatic firearm, the bolt 110 continuously cycles between these forward and rearward positions during an automatic firing mode of the firearm 100.

FIGS. 3 and 4 also show additional details of the buffer assembly 120, wherein it can be seen that the buffer assembly 120 is partially housed within the buttstock 106 and located directly behind the bolt 110. As shown, the buffer assembly 120 consistent with the prior art includes a buffer tube 130, a buffer 140 and a buffer spring 150. The buffer tube 130 extends from the bolt carrier group 108 and into the buttstock 106. The buffer spring 150 and the buffer 140 are mounted within the buffer tube 130, wherein buffer spring 150 is mounted at one end over the buffer 140. As installed, the buffer 140 is adjacent to and in contact with the bolt 110 while the opposite end of the buffer spring 150 is adjacent to and in contact with an end wall 132 of the buffer tube. In this arrangement, the buffer spring 150 forces the buffer 140 against the bolt 110 to bias the bolt 110 into the forward position. The force of the spring 150 provides the necessary force to return the bolt 110 from the rearmost position after firing back forward to pick up and load a new round. This arrangement also functions to reduce the recoil of the firearm by spreading the force of the fired round over a greater period of time.

As can be seen at FIG. 3, the buffer spring 150, via the buffer 140, has forced the bolt 110 into the forward most position, wherein the next round 112 (not visible in FIG. 3) is loaded into the chamber 114 and is ready for firing. It is noted that even in this position, the buffer spring 150 is compressed to a length L1 and does not extend to its full free length. In the embodiment shown, length L1 is about 6.74 inches.

As can be seen at FIG. 4, the buffer spring 150 and buffer 140 have been forced rearward by the movement of the bolt 110 into its rearward most position. In this position, a bumper 142 of the buffer 140 is in contact with the end wall 132 of the buffer tube 130, with the buffer spring 150 being in a fully compressed state. In this position, the buffer spring 150 is compressed to a length L2. In the embodiment shown, length L2 is about 3.0 inches.

Figure 5:
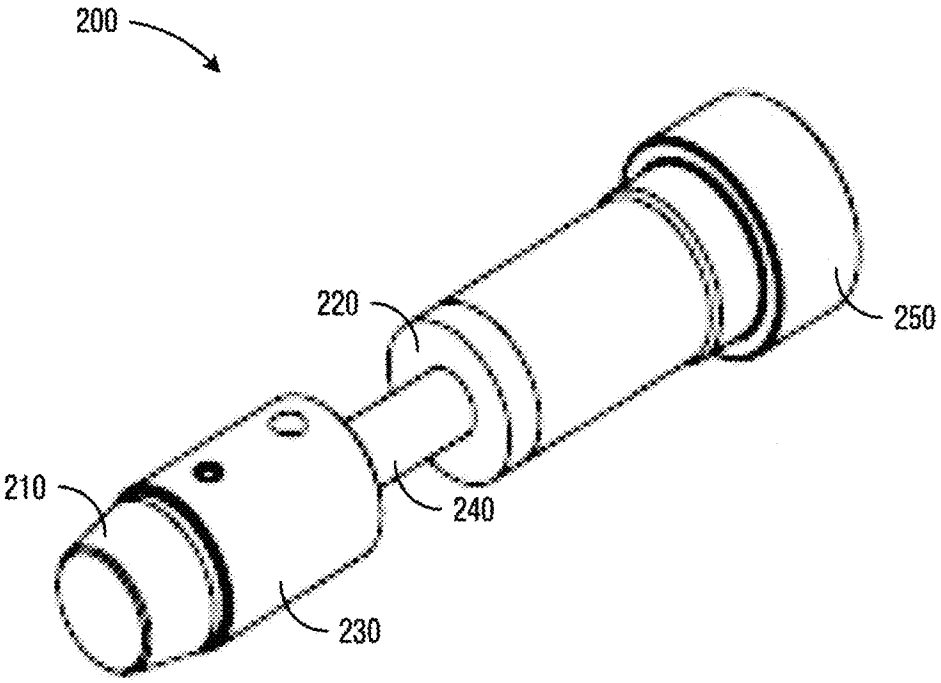
FIG. 5 is an isometric view of a buffer assembly in accordance with the present invention.

Referring to FIG. 5, the buffer 140 of the prior art may be easily replaced with an improved buffer assembly 200. The improved buffer assembly 200 is shaped to replace the buffer 140 of the prior art and provide the benefits of reducing the recoil as stated previously. FIG. 5 is an isometric view of the improved buffer assembly 200 in accordance with the present invention. The improved buffer assembly 200 incudes a bumper 210, a tail piece 230, an end-cap 220, an op-rod sleeve 240 and a main body 250, among other components described hereinbelow. Unless otherwise noted, the improved buffer assembly 200 may be fabricated from Aluminum or 300 series stainless steel by standard machining processes. Other materials such as mild steel, Ti6Al4V or other machineable metals may be used. The buffer assembly 200 may be serviced and has parts that are interchangeable so that if a component breaks over use, only the broken component needs to be replaced instead of the entire buffer assembly as is required with a hydraulic buffer if it breaks, for example.

Figure 6:
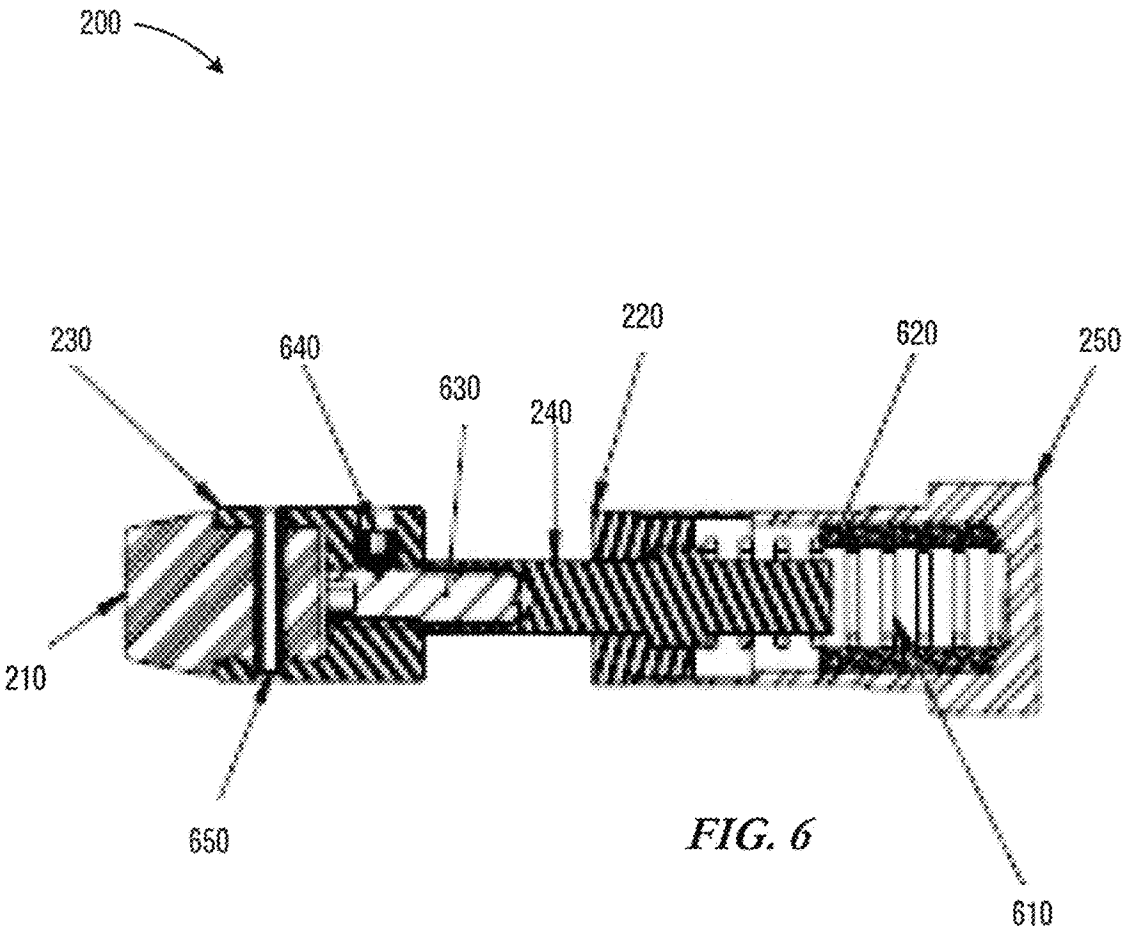
FIG. 6 is a cross-sectional view of the buffer assembly illustrated in FIG. 5.

FIG. 6 is a cross-sectional view of the improved buffer assembly 200 illustrated in FIG. 5. In FIG. 6, internal components of the improved buffer assembly 200 not visible in FIG. 5 include a spring 610, a set-screw 640, an operational rod, designated op-rod 630, a stabilizer weight 620 and a pin, for example a roll-pin type pin, designated spring pin 650. When assembling the improved buffer assembly 200, the op-rod 630 is inserted into the tail piece 230 such as by threading in, and the set screw 640 is screwed into the tail piece 230 to secure the op-rod 630 into the tail piece 230.

Figure 7A:
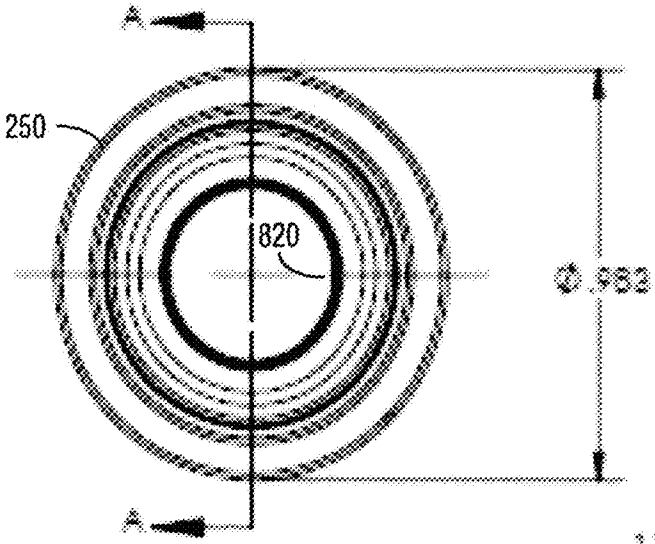
FIG. 7A is a front view of a main body of the buffer assembly.
Figure 7B:
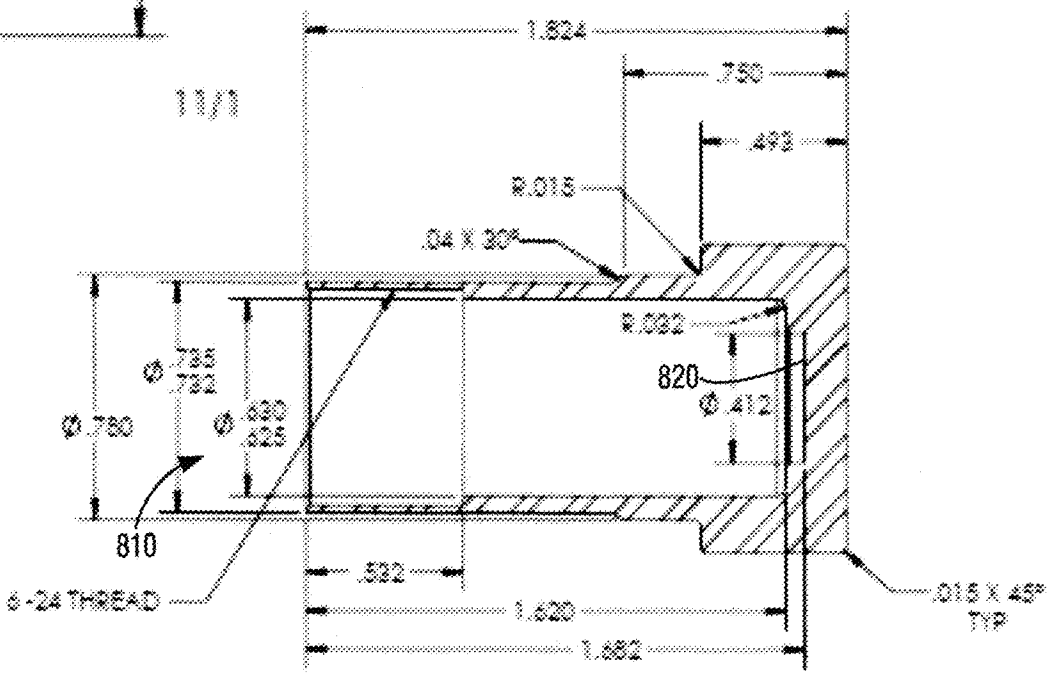

FIG. 7A is a front view of the main body 250 of the improved buffer assembly 200. In FIG. 7A the outside diameter of the main body is shown as 0.983 inches. Section A-A of the main body 250 is illustrated in FIG. 7B. FIG. 7B is a side sectional view of the main body 250 of the improved buffer assembly 200. All the dimensions necessary to manufacture the main body 250 are shown in FIG. 7B. All dimensions in all figures are designated in inches unless otherwise noted and are target dimensions that will naturally vary slightly with machining tolerances, such that the target values do not limit the scope of the invention to precise numbers illustrated, but should instead be understood to vary according to particular gun designs.

In FIG. 7, the main body 250 has an opening 810 that may have internal threads inside a portion of the opening to allow the end-cap 220 to thread in for one particular embodiment. Other methods of connecting the end-cap 220 to the main body 250 include, but are not limited to, ultrasonic welding, holding in with an adhesive or other attachment type. A recess 820 provides centering of the spring 610 inside the main body to allow the stabilizer weight 620 to move freely within the main body 250 over the centered spring 610. Movement of the stabilizer weight 620 provides a secondary closing force on the bolt of the firearm to reduce bolt bounce, particularly in automatic firing cycles. For example, stabilizer weight 620 may be manufactured from stainless steel for a semi-automatic firearm, while stabilizer weight 620 may be manufactured from a tungsten-copper alloy such as 80-20 alloy to provide additional force for fully automatic rifles.

Figure 8A:
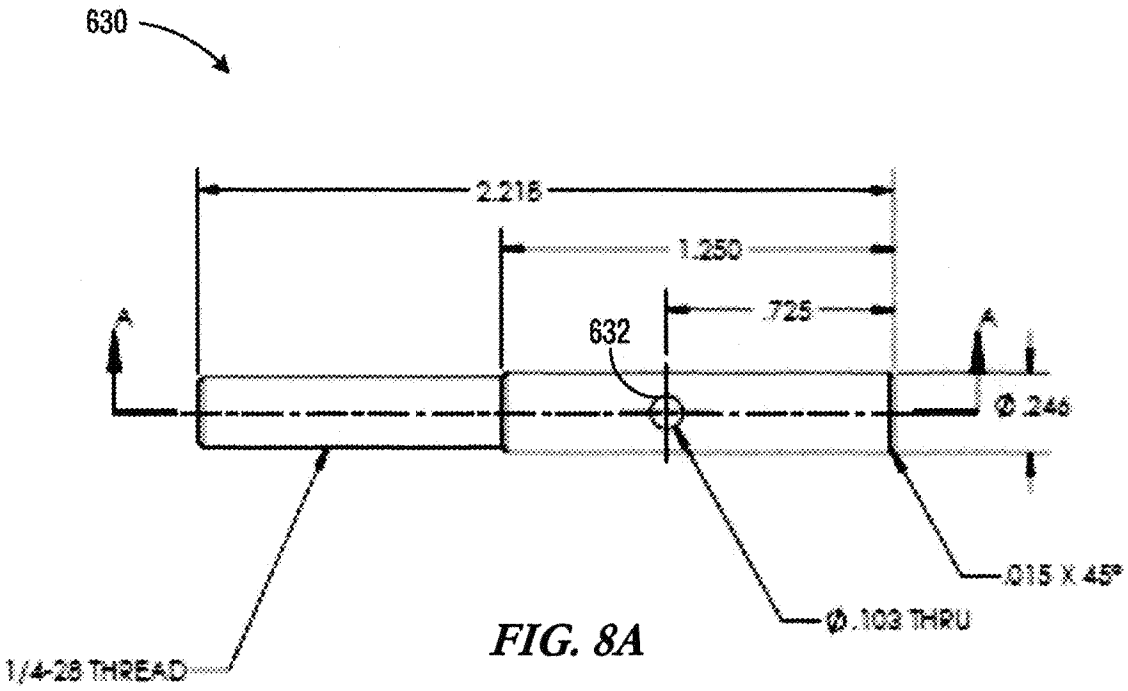
FIG. 8A is a side view of an op-rod of the buffer assembly.
Figure 8B:
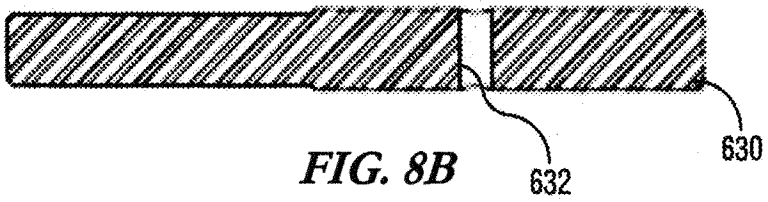
FIG. 8B is a top sectional view of the op-rod of the buffer assembly of FIG. 8A.

FIG. 8A is a side view of the op-rod 630 of the improved buffer assembly 200. The op-rod 630 includes a hole 632. All the dimensions necessary to manufacture the op-rod 630 are shown in FIG. 8A. FIG. 8B is a top sectional view of the op-rod 630 of the improved buffer assembly 200. The hole 632 extends all the way through the op-rod 630. The op-rod 630 is threaded to engage the op-rod sleeve 240. In one embodiment, the op-rod 630 is simply a threaded rod that threads into the tail piece 230 and the op-rod sleeve 240. Alternately the op-rod 630 may be as illustrated in FIG. 5, where it may be pinned into the tail piece 230. In other embodiments the op-rod 630 and op-rod sleeve 240 may be manufactured from a single rod, such that one end threads into the tail piece 230 and the other end includes an enlarged portion 920 and a second portion 930 opposite the enlarged portion 920 from the first portion 910 as will be illustrated below in FIGS. 9A, 9B and 9C.

Figure 9B:
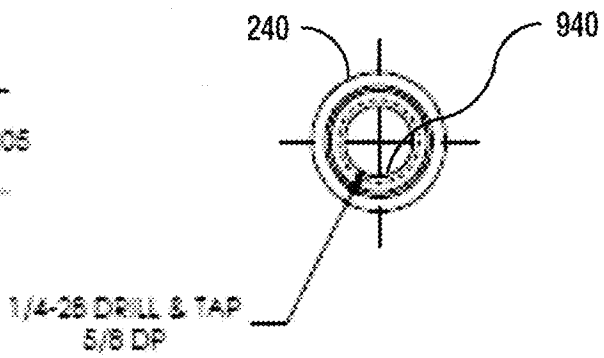
FIG. 9B is a front view of the op-rod sleeve illustrated in FIG. 9A.
Figure 9A:
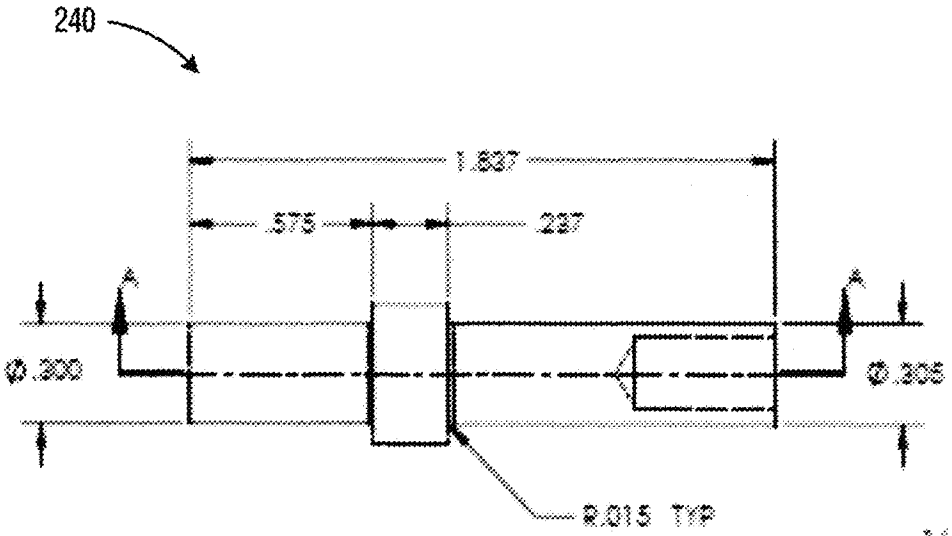
FIG. 9A is side view of an op-rod sleeve of the buffer assembly.
Figure 9C:
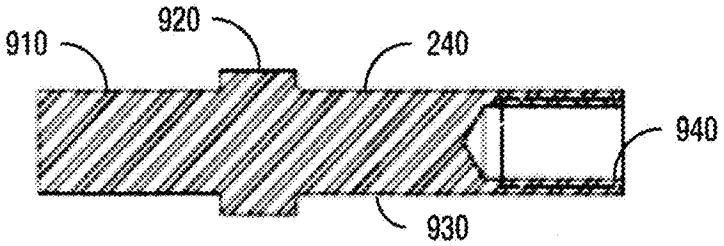
FIG. 9C is a side sectioned view of the op-rod sleeve illustrated in FIG. 9A.

FIG. 9A is side view of the op-rod sleeve 240 of the improved buffer assembly 200. The op-rod sleeve 240 includes a first portion 910, an enlarged portion 920 and a second portion 930 opposite the enlarged portion 920 from the first portion 910. The second portion 930 includes a threaded hole 940, preferably threaded ¼-28 threads to a depth of ⅝ inch. FIG. 9B is a front view of the op-rod sleeve 240 illustrated in FIG. 9A. FIG. 9C is a side sectioned view of the op-rod sleeve 240 illustrated in FIG. 9A.

Figure 10A:
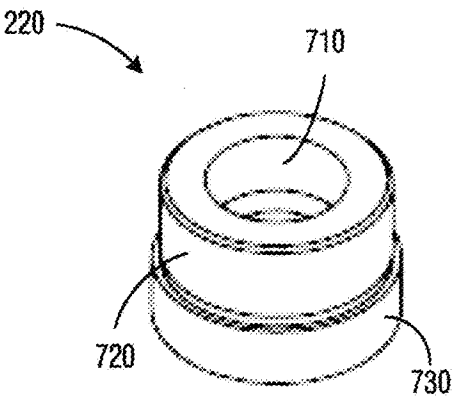
FIG. 10A is a perspective view of an end cap of the buffer assembly.

FIG. 10A is a perspective view of the end-cap 220 of the improved buffer assembly 200. The end-cap 220 contains an opening 710 sized to receive the enlarged portion 920 of the op-rod sleeve 240. A threaded surface 720 threads into the main body 250, thereby holding the op-rod sleeve 240 into the main body 250 and compressing the spring 610. Spring 610 may be manufactured from spring steel.

Figure 10B:
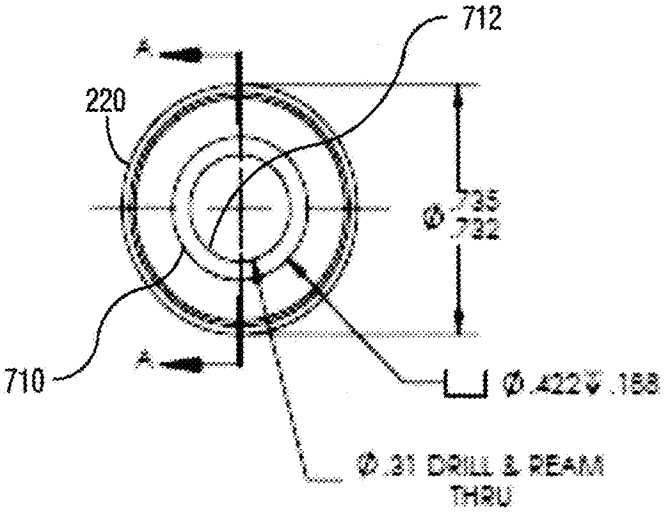
FIG. 10B is a front view of the end cap illustrated in FIG. 10A.
Figure 10C:
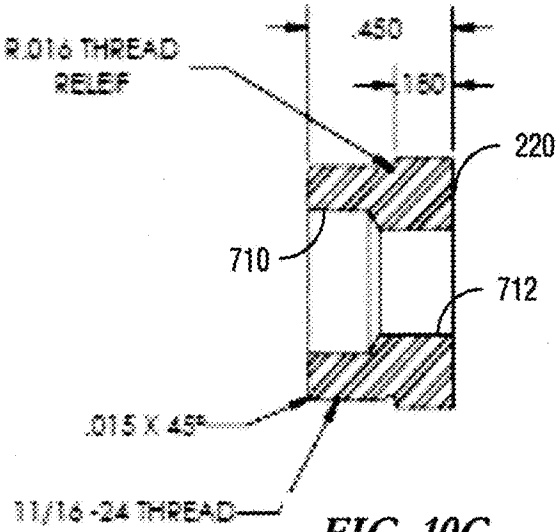
FIG. 10C is a side sectional view of the end cap illustrated in FIG. 10A.

FIG. 10B is a front view of the end-cap 220 illustrated in FIG. 10A. Sizes are provided in inches, and section A-A is identified as will be discussed further with regard to FIG. 10C. FIG. 10C is a side sectional view of the end-cap 220 illustrated in FIG. 10A. The opening 710 is shown in more detail, as well as a second smaller opening 712. The second smaller opening 712 allows the first portion 910 of the op-rod sleeve 240 to pass through the opening in a slidable manner, while retaining the op-rod 720. End-cap 220 may be fabricated from 300 series stainless steel, Ti6Al4V Titanium or other metal.

Figure 11B:
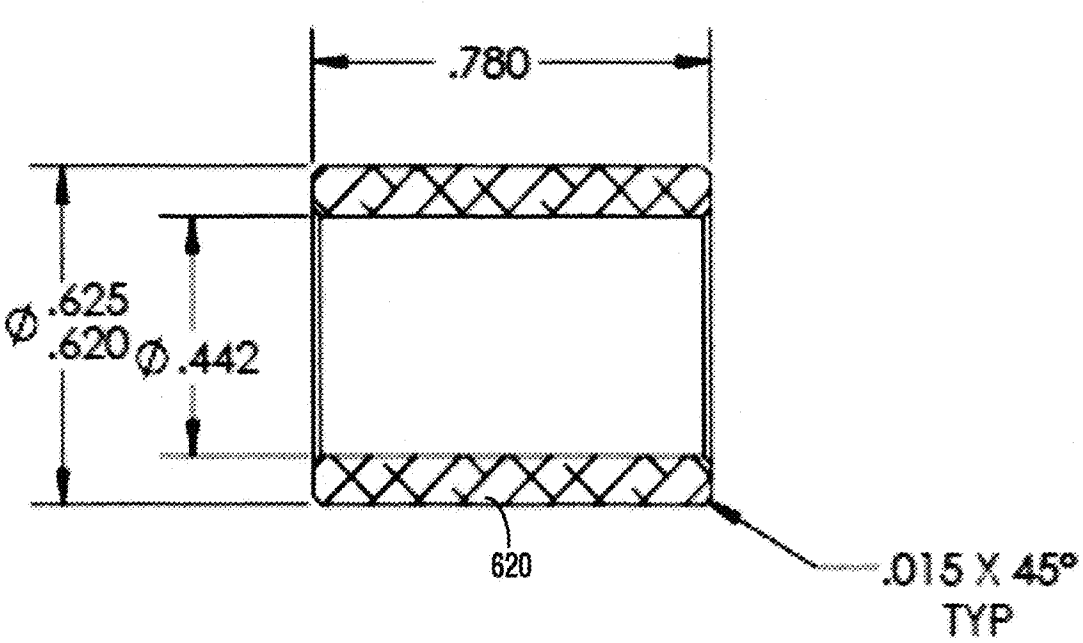
FIG. 11A is a front view of a stabilizer weight of the buffer assembly.
Figure 11A:
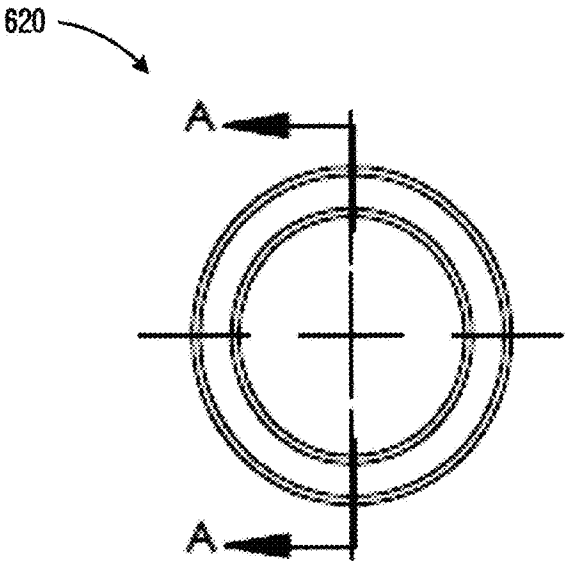

FIG. 11A is a front view of the stabilizer weight 620 of the improved buffer assembly 200. Section A-A in FIG. 11A identifies the sectional view seen in FIG. 11B. FIG. 11B is a side sectional view of the stabilizer weight 620 illustrated in FIG. 11A. The dimensions of the stabilizer weight 620 are identified to provide a weight sufficient to add mass to stabilize the recoil action. The stabilizer weight 620 may be fabricated from 300 series stainless steel, tungsten, Titanium or other material to provide a suitable weight for a particular gun/ammunition combination. For example, the weight can be increased to slow the cycle or the weight can be reduced to speed the cycle of the action, and also provide a rebound force that helps to drive the bolt forward into battery and reduce bolt bounce-back.

Figure 12A:
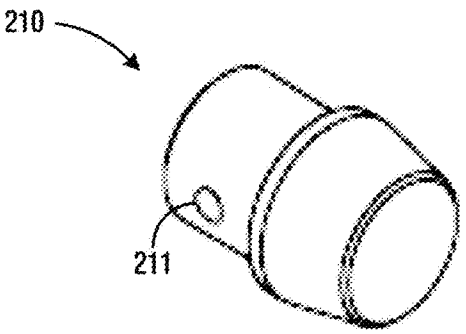
FIG. 12A is a perspective view of a bumper of the buffer assembly.
Figure 12B:
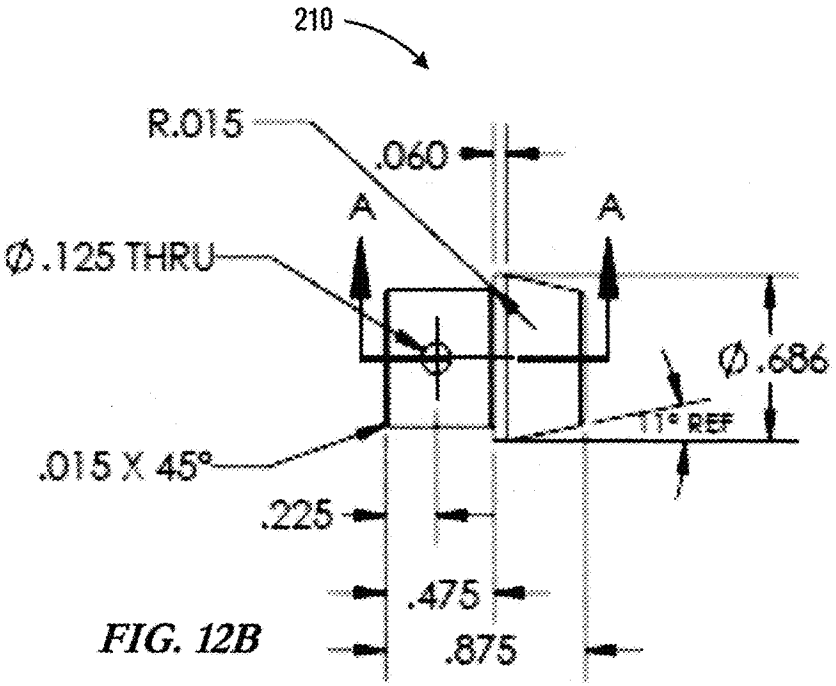
FIG. 12B is a side view of the bumper illustrated in FIG. 12A.
Figure 12C:
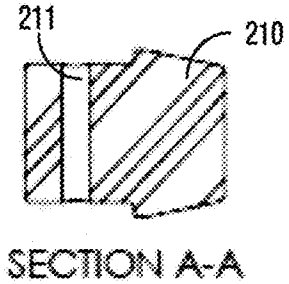
FIG. 12C is a top sectional view of the bumper illustrated in FIG. 12A.

FIG. 12A is a perspective view of the bumper 210 of the improved buffer assembly 200. The bumper 210 is sized to fit into the tail piece 230 and is held in place by the spring pin 650 that is insertable into a hole 211 after the buffer is inserted into the tail piece 230. Spring pin 650 may be manufactured from spring steel. FIG. 12B is a side view of the bumper 210 illustrated in FIG. 12A identifying dimensions suitable for the manufacture of the bumper 210. Bumper 210 may be manufactured from UHMWPE, polyurethane or other suitable rubbery material suitable for impact and shock absorption. FIG. 12C is a top sectional view of the bumper 210 illustrated in FIG. 12A identifying the hole 211 as seen through section A-A of FIG. 12B.

Figure 13B:
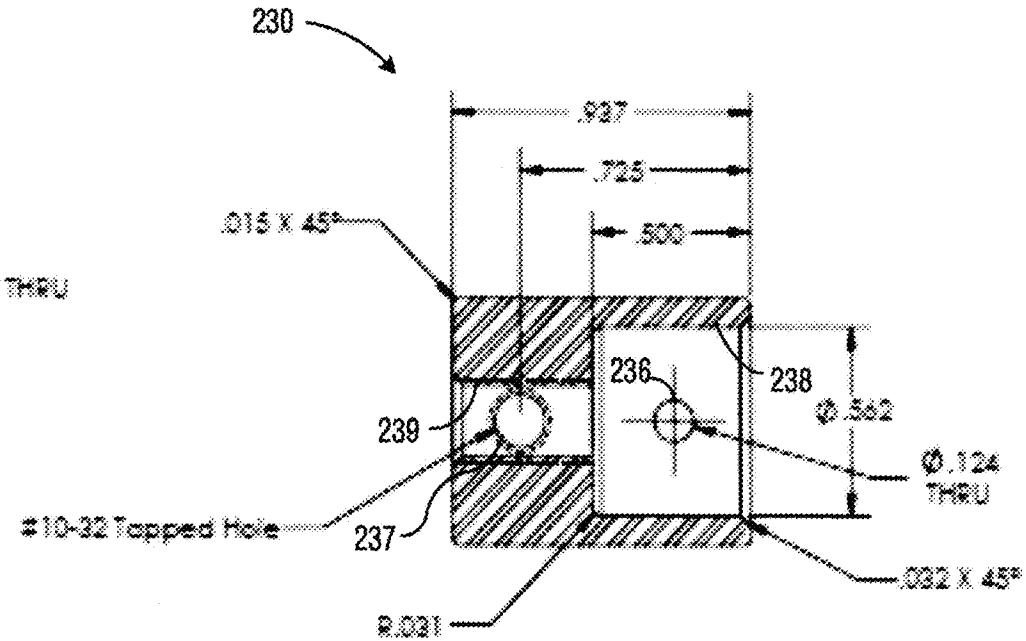
FIG. 13B is a side sectional view of the tail piece illustrated in FIG. 13A.
Figure 13A:
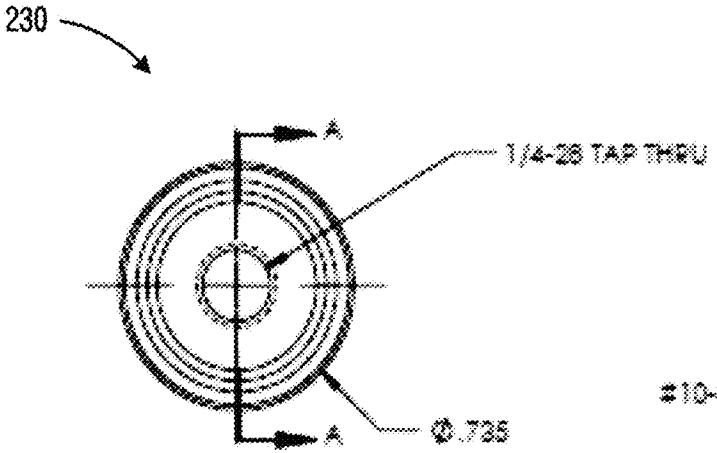
FIG. 13A is a front view of a tail piece of the buffer assembly.

FIG. 13A is a front view of the tail piece 230 of the improved buffer assembly 200. A threaded hole 239 through the center is sized to thread onto the op-rod 630. Section A-A is identified in FIG. 13A to define the view of FIG. 13B. FIG. 13B is a side sectional view of the tail piece 230 illustrated in FIG. 13A. A set screw threaded hole 237 provides for the set screw 640 to firmly hold the op-rod 630 in the threaded hole 239. An opening 238 is sized to allow the bumper 210 to slide in and align the hole 211 of the bumper 210 with a hole 236 of the tail piece 230, allowing the spring pin 650 to hold the pieces together.

In various embodiments disclosed herein, a single component can be replaced by multiple components and multiple components can be replaced by a single component to perform a given function or functions. Except where such substitution would not be operative, such substitution is within the intended scope of the embodiments.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

I claim:

1. A buffer assembly for a firearm comprising:

a main body containing a spring, the main body having a shoulder at a first end and an opening at a second end that matingly engages with an end cap;

an operational rod with a first portion slidingly contained inside the main body, wherein the first portion of the operational rod is defined by a rod diameter, and the first portion of the operational rod includes an enlarged portion, wherein the enlarged portion of the first portion of the operational rod mates into an enlarged portion of an opening in the end cap and the operational rod slidingly engages a smaller portion of the opening in the end cap such that the enlarged portion of the operational rod maintains a preload compression on the spring in the main body, the first portion of the operational rod engaging the spring such that as the operational rod reciprocatingly slides within the main body the spring is reciprocatingly compressed and decompressed;

the operational rod having a second portion outside the main body, the second portion terminating in a bumper.

2. A firearm comprising the buffer assembly of claim 1.

3. The buffer assembly of claim 1, wherein the bumper comprises an elastomeric portion removably attached to a tail piece, and wherein the termination of the second portion of the operational rod terminates in the tail piece.

4. The buffer assembly of claim 3, wherein the operational rod is coupled to the tail piece using a set screw.

5. The buffer assembly of claim 3, wherein the elastomeric portion is attached to the tail piece using a spring biased pin.

6. The buffer assembly of claim 1, wherein the end cap has an externally threaded portion and the opening of the main body has an internally threaded portion that matingly engages the externally threaded portion of the end cap to hold the end cap onto the main body.

7. The buffer assembly of claim 1, wherein the buffer assembly is removably insertable in at least one of an AR-15, M16, M4 carbine, SR-25, AR-10 and LR-308 type rifle.

8. The buffer assembly of claim 1, wherein the bumper comprises polyurethane.

9. The buffer assembly of claim 1, wherein the bumper comprises Ultra High Molecular Weight PolyEthylene.

10. The buffer assembly of claim 1, wherein the rod diameter of the first portion of the operational rod extends into the spring to at least a depth of about 30% of the decompressed length of the spring thereby positioning the spring within the main body for smooth operation of compression and decompression.

11. A buffer assembly for a firearm comprising:

a main body containing a spring, the main body having a shoulder at a first end and an opening at a second end that matingly engages with an end cap;

an operational rod with a first portion slidingly contained inside the main body, wherein the first portion of the operational rod is defined by a rod diameter, and the first portion of the operational rod includes an enlarged portion, wherein the enlarged portion of the first portion of the operational rod mates into an enlarged portion of an opening in the end cap and the operational rod slidingly engages a smaller portion of the opening in the end cap such that the enlarged portion of the operational rod maintains a preload compression on the spring in the main body, the first portion of the operational rod engaging the spring such that as the operational rod reciprocatingly slides within the main body the spring is reciprocatingly compressed and decompressed; and the operational rod has a second portion outside the main body, the second portion terminating in a bumper, wherein the bumper comprises an elastomeric portion removably attached to a tail piece, wherein the bumper comprises polyurethane and wherein the termination of the second portion of the operational rod terminates in the tail piece, wherein the end cap has an externally threaded portion and the opening of the main body has an internally threaded portion that matingly engages the externally threaded portion of the end cap to hold the end cap onto the main body.

* * * * *